US009199460B2

(12) United States Patent
Ge et al.

(10) Patent No.: US 9,199,460 B2
(45) Date of Patent: Dec. 1, 2015

(54) APPARATUSES INCLUDING A PLATE HAVING A RECESS AND A CORRESPONDING PROTRUSION TO DEFINE A CHAMBER

(71) Applicant: Hewlett-Packard Development Company, L. P., Houston, TX (US)

(72) Inventors: Ning Ge, Singapore (SG); Adam L. Ghozeil, Corvallis, OR (US); Kenneth Hickey, Dublin (IE); Chaw Sing Ho, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 151 days.

(21) Appl. No.: 13/931,361

(22) Filed: Jun. 28, 2013

(65) Prior Publication Data

US 2015/0001321 A1 Jan. 1, 2015

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/1433* (2013.01); *B41J 2/1404* (2013.01); *B41J 2/162* (2013.01); *B41J 2/1625* (2013.01); *B41J 2/1628* (2013.01); *B41J 2/1631* (2013.01); *B41J 2/1642* (2013.01); *B41J 2/1639* (2013.01); *B41J 2202/11* (2013.01); *Y10T 29/49432* (2015.01)

(58) Field of Classification Search

CPC ..... B41J 2/135; B41J 2/14; B41J 2/14016; B41J 2/1404; B41J 2/1433; B41J 2002/14411; B41J 2/14153; B41J 2002/14354; B41J 2/16579; B41J 2002/14403; B41J 2/1603

See application file for complete search history.

(56) References Cited

U.S. PATENT DOCUMENTS

| | | | | |
|---|---|---|---|---|
| 7,600,856 | B2 * | 10/2009 | Lebens et al. | 347/56 |
| 2008/0303884 | A1 * | 12/2008 | Miura | 347/93 |

* cited by examiner

*Primary Examiner* — Geoffrey Mruk

(74) *Attorney, Agent, or Firm* — Hewlett-Packard Patent Department

(57) ABSTRACT

An example provides an apparatus including a plate having a nozzle orifice, a flat portion, and a first surface having a recess forming a corresponding protrusion extending from a second surface, opposite first surface, of the plate. A substrate may be in spaced relation to the flat portion of the plate such that the protrusion extends toward the substrate and such that the flat portion and the substrate define, at least in part, a chamber.

13 Claims, 14 Drawing Sheets

APPARATUSES INCLUDING A PLATE HAVING A RECESS AND A CORRESPONDING PROTRUSION TO DEFINE A CHAMBER

BACKGROUND

A number of devices may be implemented with voids (such as, e.g., a chamber or channel) within layers of the device. Printheads, for example, may include firing chambers, ink feed slots, or ink channels. Micro-electrical-mechanical systems devices may include air chambers to house components and/or to provide functionality to the devices. In some of these examples, layers may be separated by forming multiple layers and etching voids in the layers and then bonding another layer onto the built-up layers.

BRIEF DESCRIPTION OF THE DRAWINGS

The Detailed Description section references the drawings, wherein.

all in which various embodiments may be implemented.

Certain examples are shown in the above-identified figures and described in detail below. The figures are not necessarily to scale, and various features and views of the figures may be shown exaggerated in scale or in schematic for clarity and/or conciseness.

DETAILED DESCRIPTION

Device features continue to decrease in size. Printheads, for instance, may realize improved print quality as the number of nozzles increase. Devices that incorporate micro-and-smaller electrical-mechanical systems (generally referred to herein as "MEMS") devices, by definition, as very small and continue to serve a broad range of applications in a broad range of industries.

Fabrication of small device features cost-effectively and with high performance and reliability, however, continues to challenge process designers. Continuing with the printhead example, an increased number of nozzles and/or decreased printhead size may sometimes take the form of shorter shelf lengths or decreased spacing between barrier peninsulas, or both, which may limit the available spacing for barrier islands for filtering out particles in a printing fluid before reaching the nozzles.

Described herein are implementations of apparatuses including a plate having a recess and a corresponding protrusion to define a chamber between the plate and a substrate. In various implementations, the protrusion may filter particles from a fluid from entering a firing chamber of a fluid ejection apparatus. In further implementations, the protrusion of the plate may be in electrical contact with an on-substrate bond pad while the flat portion of the plate may capacitively couple with a capacitor terminal on the substrate to detect air bubbles in the fluid. In still further implementations, the plate may be incorporated into any number of MEMS-based apparatuses.

Figure 1:
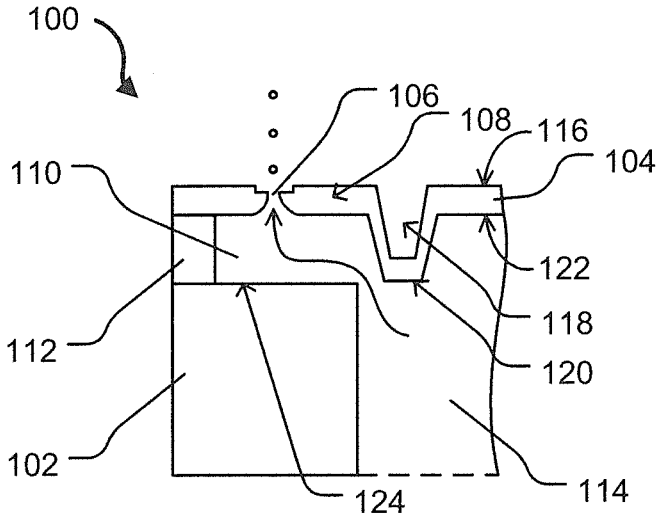
FIGS. 1-12 illustrate various examples of example fluid ejection apparatuses.

An example fluid ejection apparatus 100 is illustrated in FIG. 1. As illustrated, the apparatus 100 may include a substrate 102 and a plate 104 having at least one nozzle orifice

106 through which drops of a fluid (such as, e.g., ink, etc.) may be ejected. The substrate 102 may be in spaced relation to a flat portion 108 of the plate 104 such that the flat portion 108 and the substrate 102 define, at least in part, a firing chamber 110. In some implementations, the apparatus 100 may include a barrier layer 112 between the substrate 102 and the plate 104. The barrier layer 112 may help define the firing chamber 110, as described elsewhere. In various implementations, the apparatus 100 may comprise, at least in part, a printhead or printhead assembly. In some implementations, for example, the fluid ejection apparatus 100 may be an inkjet printhead or inkjet printing assembly.

The substrate 102 may include a fluid feed slot 114 to provide a supply of fluid to the nozzle orifice 106 via the firing chamber 110. In many implementations, the apparatus 100 may include a plurality of firing chambers 110 fluidically coupled to at least one of a plurality of nozzle orifices similar to the nozzle orifice 106 illustrated, and in at least some of these implementations, the fluid feed slot 114 may provide fluid to all or most of the plurality of nozzle orifices via corresponding ones of the firing chambers 110.

A first surface 116 of the plate may include a recess 118 forming a corresponding protrusion 120 integral to the plate 104 and extending from a second surface 122 toward the fluid feed slot 114 of the substrate 102, as illustrated. In various implementations, the protrusion 120 may filter particles in the fluid from entering the firing chamber 110 as the fluid flows from the fluid feed slot 114 to the firing chamber 110, and this filtering may help avoid clogging of the nozzle orifice 106 as compared to a structure without the protrusion 120.

The plate 104 may comprise one layer or multiple layers of metal or another conductive material resistant to corrosion and/or mechanical damage. In various implementations, the plate 104 may comprise nickel, gold, platinum, palladium, rhodium, titanium, or another metal or alloys thereof. In some implementations, the plate 104 may comprise an electroplated layer of at least one of gold, palladium, rhodium, or another metal. As described more fully elsewhere, the plate 104 may be separately formed from one or more other components of the apparatus 100 and then coupled to the substrate 102. As such, rather than forming barrier structures on the substrate 102, typically on the shelf 124, which may have limited spacing, using the plate 104 real estate may allow for particle protection without the use of complex fabrication techniques. In various implementations, the plate 104 may allow for continued decrease in device size.

Figure 2:
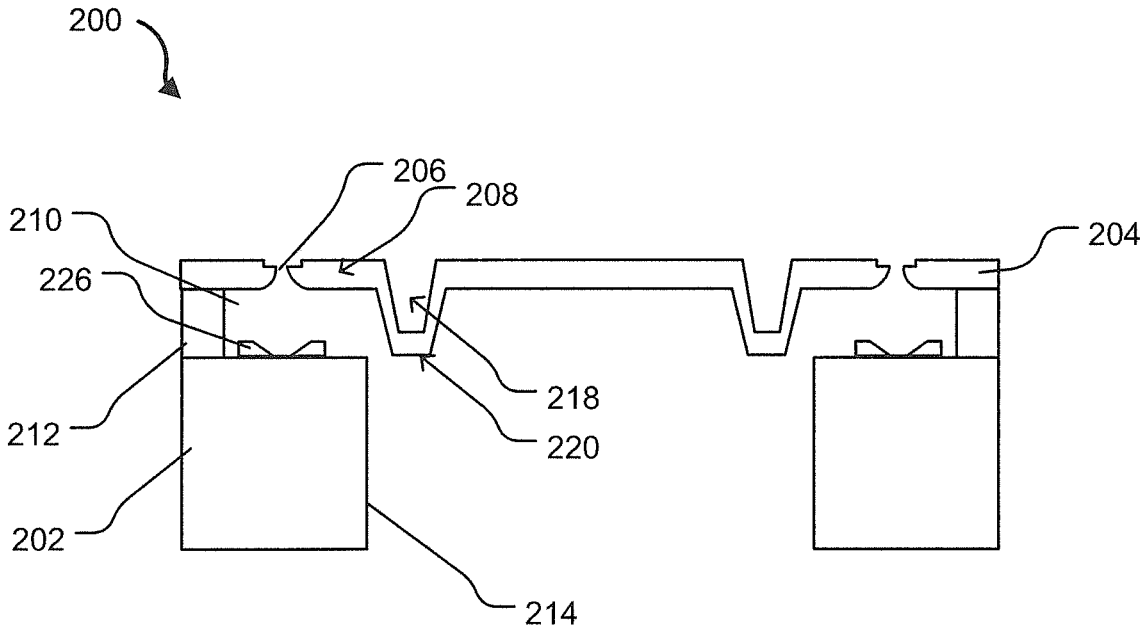

FIGS. 2-9 illustrate various examples of configurations for a plate that may be used for various implementations described herein. FIG. 2 illustrates a sectional view of an example apparatus 200 including a substrate 202 coupled to a plate 204 by a barrier layer 212. The plate 204 includes at least one nozzle orifice 206. The flat portion 208 of the plate 204, the substrate 202, and the barrier layer 212 define, at least in part, a plurality of firing chambers 210. The plate 204 includes recesses 218 forming corresponding protrusions 220 integral to the plate 204 and extending toward the substrate 202 to filter particles in a fluid from entering the firing chamber 210 as the fluid flows from a fluid feed slot 214 to the firing chamber 210.

The apparatus 200 further includes an actuator 226 in each firing chamber 210. The actuators 226 may be configured to deflect into a corresponding one of the firing chambers 210 to cause fluid to be ejected through a corresponding one of the nozzle orifices 206. In some implementations, the actuators 226 may comprise resistive or heating elements. In some implementations, the actuators 226 comprise split resistors or single rectangular resistors. Other types of actuators such as, for example, piezoelectric actuators or other actuators may be used for the actuators 226 in other implementations.

Figure 3:
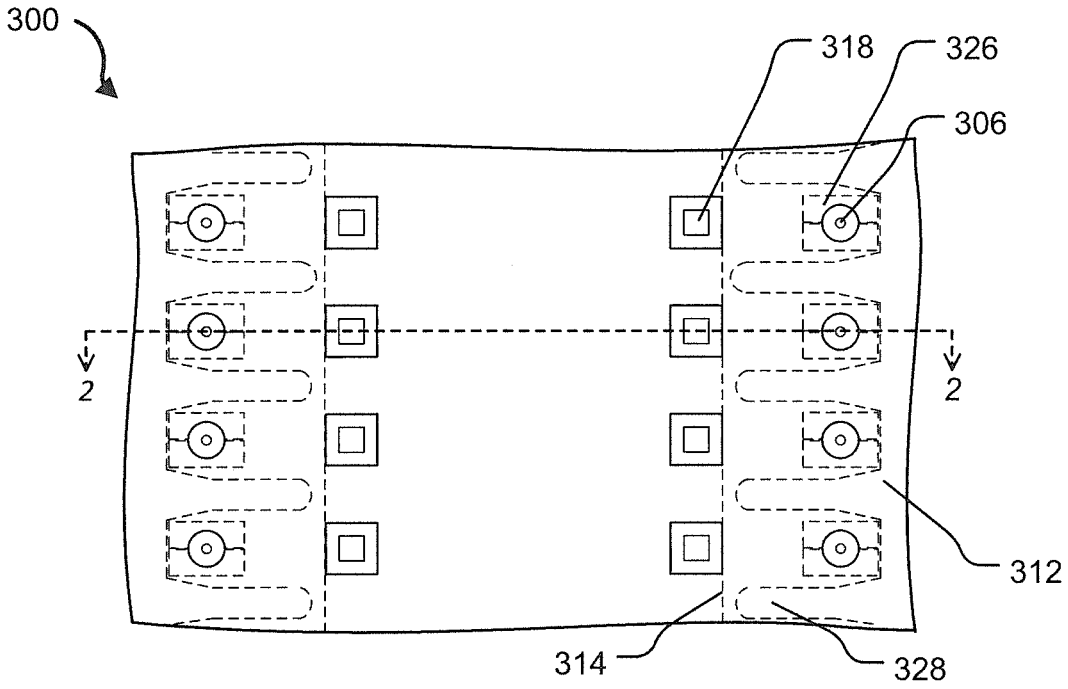
Figure 4:
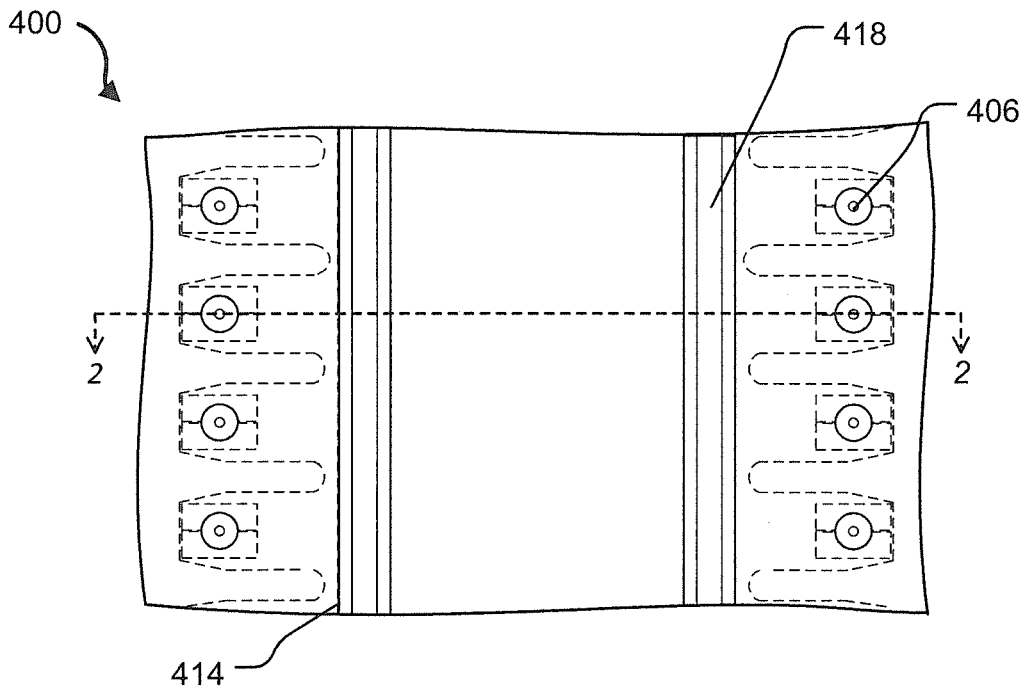

FIG. 3 and FIG. 4 illustrate examples of fluid ejection apparatuses 300 and 400, respectively, that may have sectional views similar to that shown in FIG. 2, with underlying layers shown with hashed lines. In FIG. 3, the apparatus 300 includes a plate having multiple recesses 318 forming corresponding protrusions (not explicitly shown here), with a recess 318/protrusion per each nozzle orifice 306. The apparatus 300 further includes actuators 326. The substrate 302 may be coupled to the plate 304 by a barrier layer 312. As illustrated, the barrier 312 includes peninsulas 328 extending toward the fluid feed slot 314 to define the individual firing chambers.

In FIG. 4, the apparatus 400 includes a plate having a recess 418 with corresponding protrusion (not explicitly shown here) along each column of nozzle orifices 406, rather than individual recesses 418/protrusions for each nozzle orifice 406.

Figure 5:
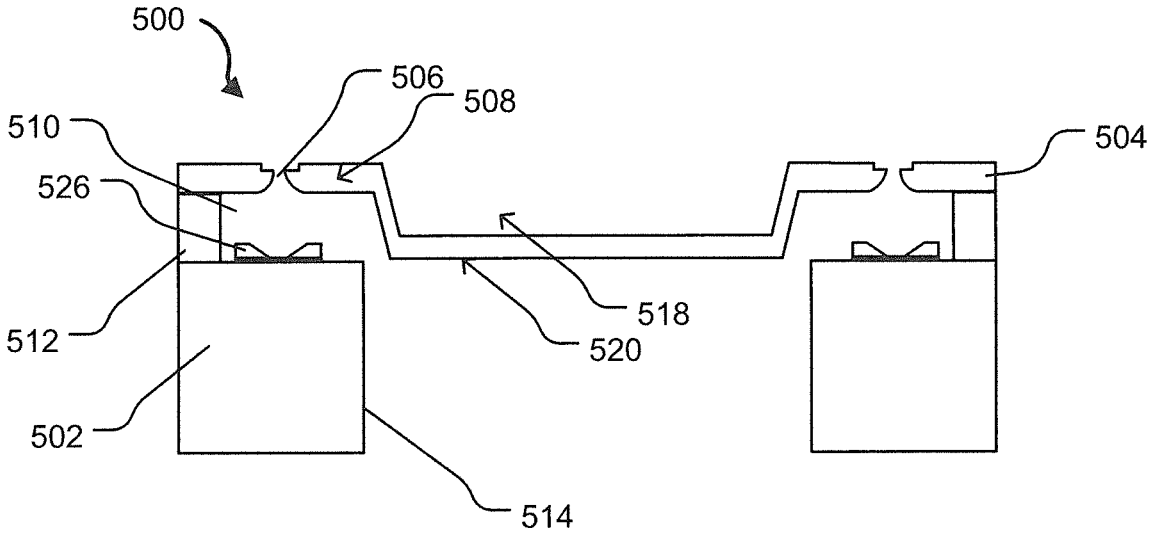

FIG. 5 illustrates a sectional view of an example apparatus 500 including a substrate 502 coupled to a plate 504 by a barrier layer 512. The plate 504 includes at least one nozzle orifice 506 and a corresponding actuator 526. The flat portion 508 of the plate 504, the substrate 502, and the barrier layer 512 define, at least in part, a plurality of firing chambers 510. The plate 504 includes a recess 518 forming a corresponding protrusion 520 integral to the plate 504 and extending toward the substrate 502 to filter particles in a fluid from entering the firing chambers 510 as the fluid flows from a fluid feed slot 514 to the firing chamber 510. As illustrated, the recess 518/protrusion 520 spans across the apparatus 100 to filter particles for nozzle orifices 506 on both sides of the apparatus 500.

Figure 6:
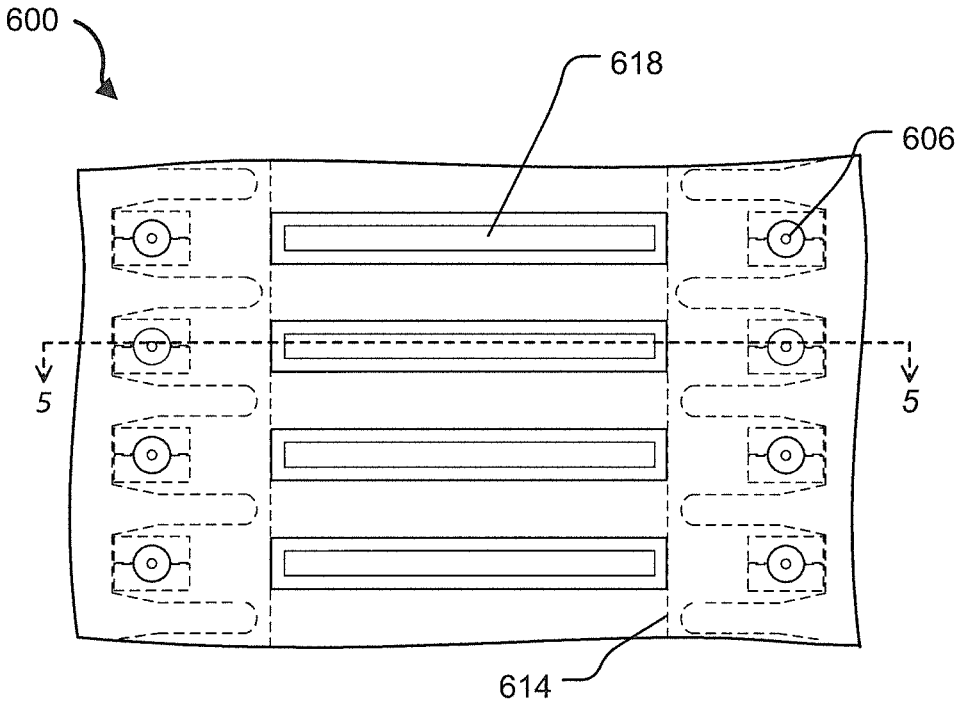
Figure 7:
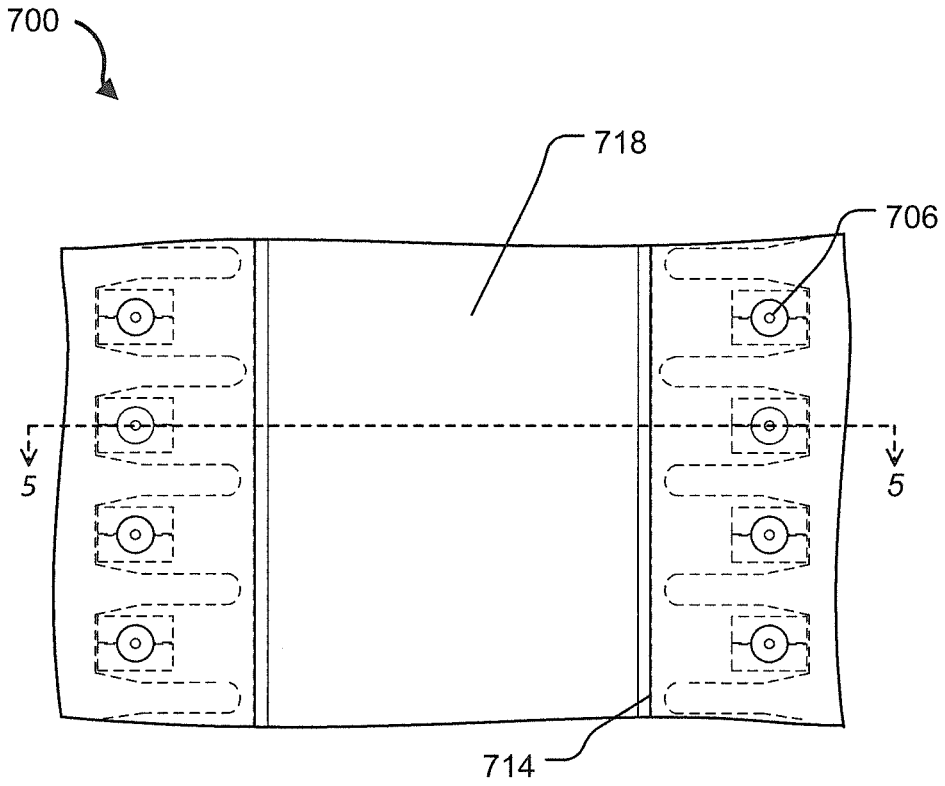

FIG. 6 and FIG. 7 illustrate examples of fluid ejection apparatuses 600 and 700, respectively, that may have sectional views similar to that shown in FIG. 5, with underlying layers shown with hashed lines. In FIG. 6, the apparatus 600 includes a plate having multiple recesses 618 forming corresponding protrusions (not explicitly shown here) spanning across the fluid feed slot 614, with a recess 618/protrusion per pair of nozzle orifices 606. In FIG. 7, the apparatus 700 includes a plate having a recess 718 forming a corresponding protrusion (not explicitly shown here) spanning across the fluid feed slot 714, with the recess 718/protrusion forming a particle filter for the plurality of the nozzle orifices 706, as illustrated.

Figure 8:
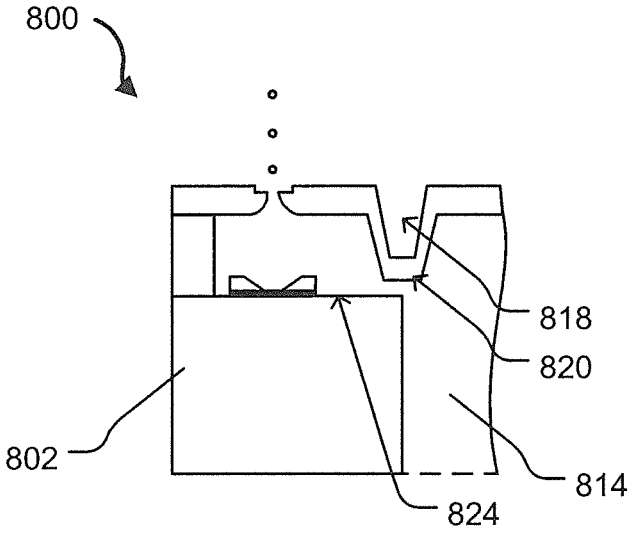
Figure 9:
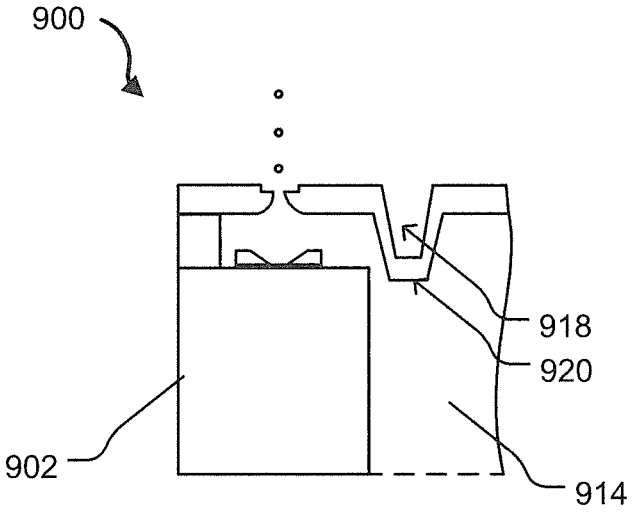

Although the various implementations of the plate illustrated thus far depict the recess/protrusion of the plate as being directly over the fluid feed slot and separated from the substrate by a distance no greater than a height of the protrusion, other configurations may be possible. FIG. 8, for example, illustrates a fluid ejection apparatus 800 including the recess 818/protrusion 820 partially over the fluid feed slot 814 and partially over the shelf 824 of the substrate 802. FIG. 9 illustrates a fluid ejection apparatus 900 including the recess 918/protrusion 920 over the fluid feed slot 914 but also sitting closer to the substrate 902 such that the protrusion 920 dips into the fluid feed slot 914, as illustrated. Numerous other configurations may be possible within the scope of the present disclosure.

Figure 10:
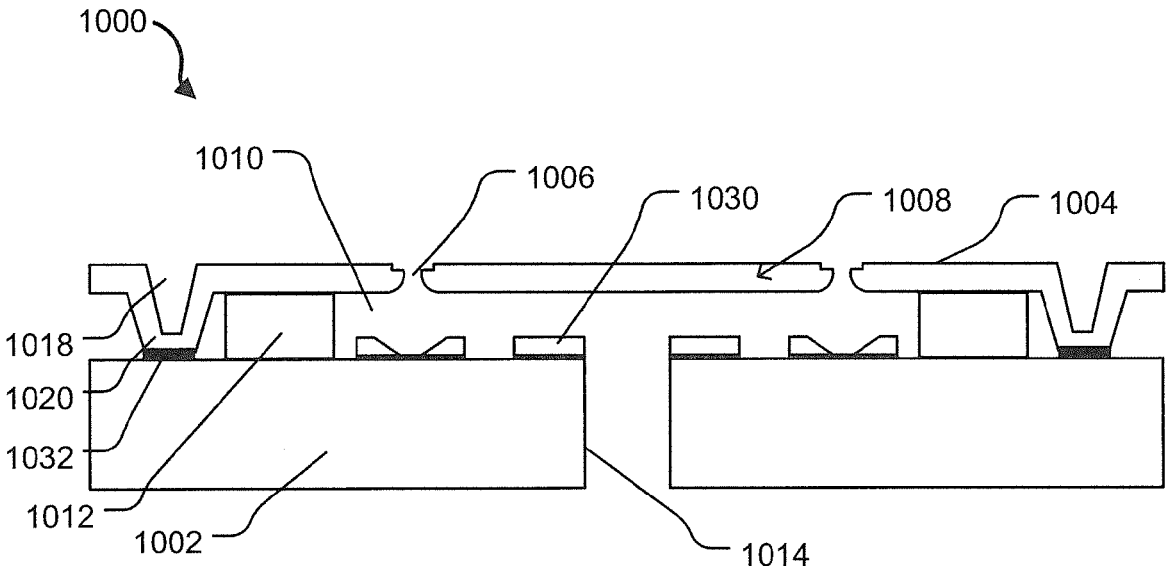

The plate of the present disclosure may be used for a wide variety of fluid-ejection and non-fluid-ejection applications. FIG. 10 illustrates another fluid ejection apparatus 1000 that may include a plate 1004 to form part of an air bubble detector to detect air bubbles in a fluid in the fluid chamber 1010. Detection of an air bubble and/or length of time an air bubble is detected in the firing chamber 1010 may provide information regarding the performance of the apparatus 1000. For instance, detecting an air bubble may simply provide an indication as to whether the nozzle orifice 1006/firing chamber 1010 ejected fluid. In some implementations, if an air bubble is detected for a long-then-expected period, this may indicate a low ink level, fluid feed slot 1014 noise, some other performance-related issue, or a combination thereof.

As illustrated in FIG. 10, the apparatus 1000 includes a substrate 1002 coupled to a flat portion 1008 of the plate 1004 by a barrier layer 1012. The plate 1004 includes a plurality of nozzle orifices 1006 with corresponding actuators 1026. The flat portion 1008 of the plate 1004, the substrate 1002, and the barrier layer 1012 define, at least in part, a plurality of firing chambers 1010 to fluidically couple the nozzle orifice 1006 with the fluid feed channel 1014. As in other implementations, the plate 1004 includes recesses 1018 forming corresponding protrusions 1020 integral to the plate 1004 and extending toward the substrate 1002

The apparatus 1000 may include a circuit pattern having a first capacitor terminal 1030 within the firing chamber 1010 and a bond pad 1032 external to the firing chamber 1010, as illustrated. In this implementation, the protrusions 1020 may be in electrical contact with the substrate 1002 by the on-substrate bond pad 1032. The flat portion 1008 of the plate 1004 may form a second capacitor terminal to capacitively couple with the first capacitor terminal 1030 to determine the presence of an air bubble in a fluid in the firing chamber 1010, as illustrated in FIG. 11 and FIG. 12.

Figure 11:
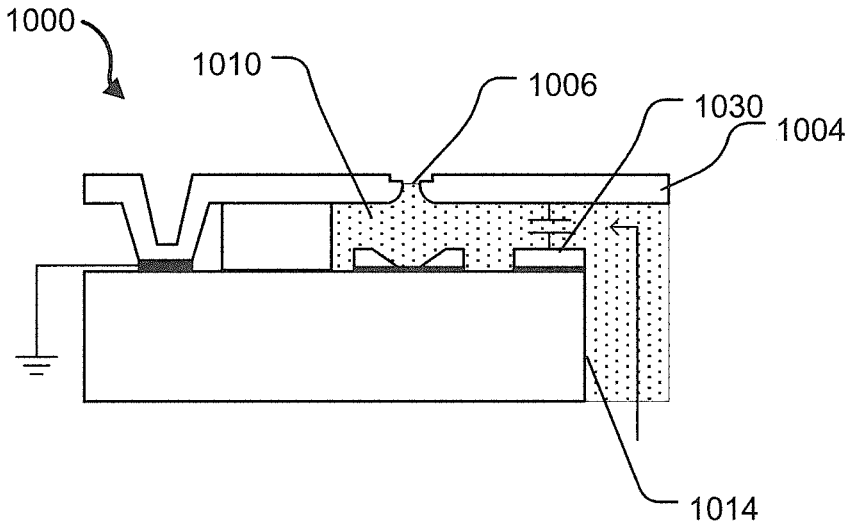
Figure 12:
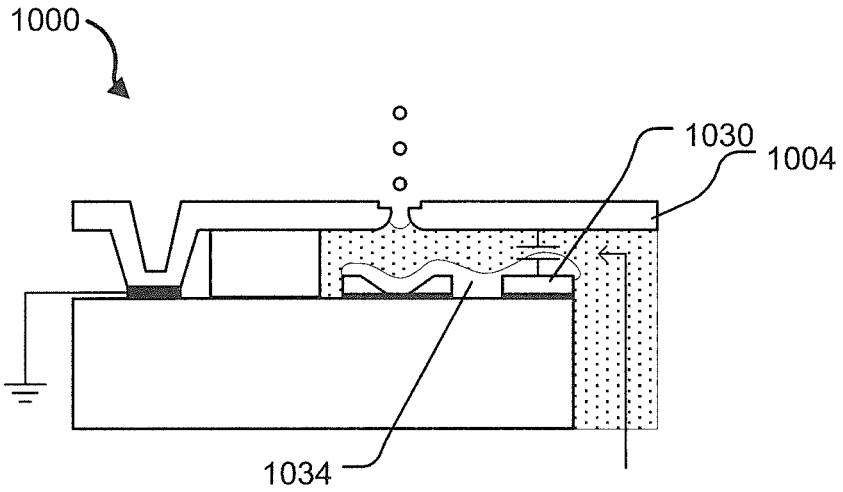

As shown in FIG. 11, as fluid flows through the fluid feed slot 1014 to the firing chamber 1010 and then to the nozzle orifice 1006, without an air bubble, the capacitance as measured between the first capacitor terminal 1030 and the plate 1004 (the second capacitor terminal) may be a first capacitance value. On firing of the fluid from the nozzle orifice 1006, as illustrated in FIG. 12, an air bubble 1034 may appear in the fluid between the first capacitor terminal 1030 and the plate 1004, which may provide a second capacitance value. Detection of a change in the capacitance values measured between the first capacitor terminal 1030 and the plate 1004 may indicate the presence of an air bubble 1034.

The plates described herein may also be included in MEMS applications such as, but not limited to, microphones, pressure sensors (e.g., variable capacitance pressure sensors, etc.), radio-frequency devices, etc. By coupling a substrate with a protrusion of the plates described herein, complicated and costly build-up and/or multiple-wafer bonding processes may be avoided or minimized.

Figure 13:
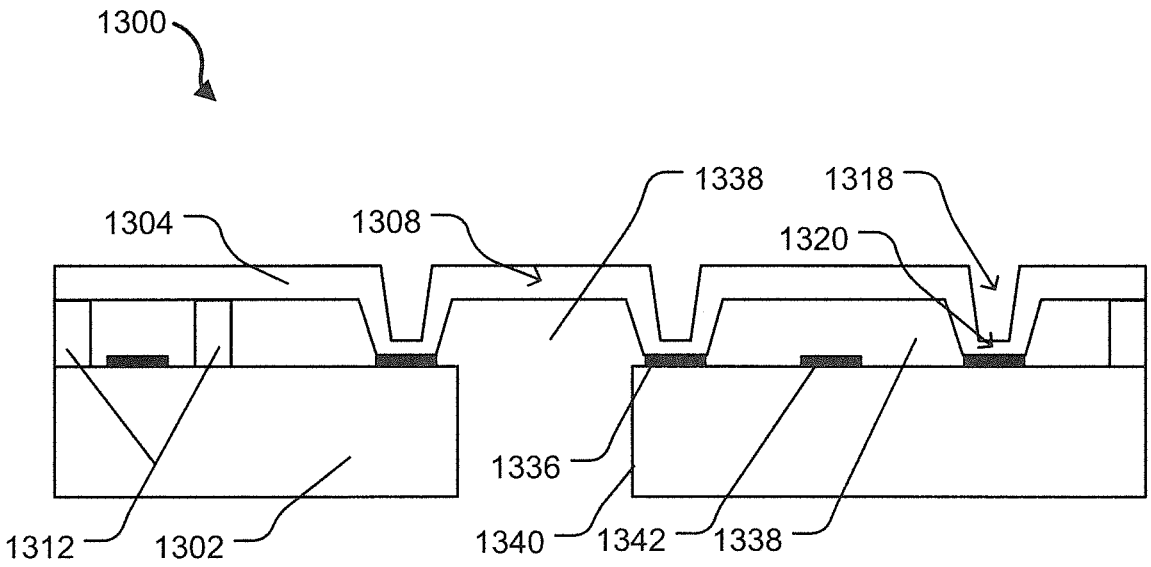
FIG. 13 illustrates an example MEMS-based apparatus.

FIG. 13 illustrates an example MEMS-based apparatus 1300 including a plate 1304 having recesses 1318 with corresponding protrusions 1320. A substrate 1302 may be coupled to a flat portion 1308 of the plate 1304 by a barrier layer 1312. The protrusions 1320 may be in electrical contact with bond pads 1336 of a circuit pattern of the substrate 1302. As illustrated, the protrusions 1320 extend toward the substrate 1302 such that the flat portion 1308 of the plate 1304 is in spaced relation to the substrate 1302 to define at least one chamber 1338.

In various implementations, the substrate 1302 may include a trench 1340. In some of these latter implementations, the apparatus 1300 may be a pressure sensor and the trench 1340 may comprise a pressure inlet of the sensor. In other implementations, the circuit pattern of the substrate 1302 may include a capacitor terminal 1342 to capacitively couple with the flat portion 1308 of the plate to form a variable capacitance pressure sensor. Numerous other MEMS applications may be possible within the scope of the present disclosure.

Various operations of methods for forming an apparatus including a plate, or a system including such an apparatus, is illustrated in FIGS. 14-22 by way of sectional views of the apparatus at various stages of the methods. It should be noted that various operations discussed and/or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

Figure 14:
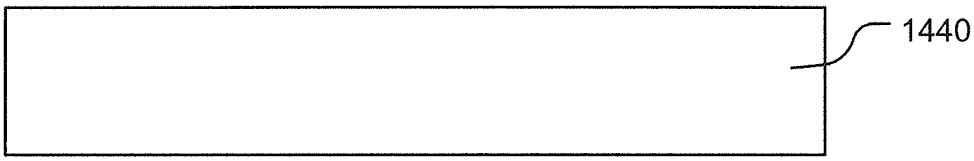
FIGS. 14-21 illustrate various stages of methods for forming an apparatus including a plate having a recess and a corresponding protrusion to define a chamber.

Turning now to FIG. 14, a method for forming an apparatus with a plate, in accordance with various implementations, may begin or proceed with providing a mandrel 1440. The mandrel 1440 may comprise glass, soda-lime-silica glass, or another material onto which a metal may be sputtered or otherwise formed in accordance with one or more operations described herein.

Figure 15:
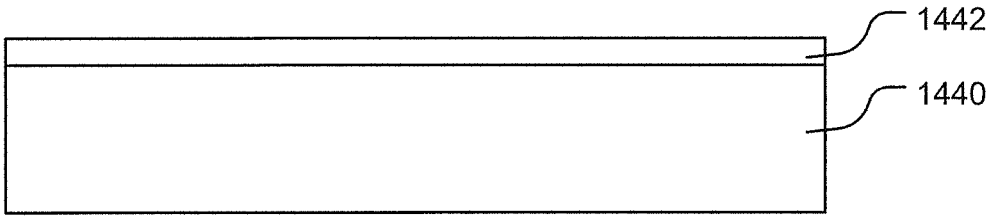

At FIG. 15, a masking material 1442 may be formed over the mandrel 1440, as illustrated. The masking material 1442 may typically comprise a photoresist material, either positive or negative, that may be patterned through exposure and development. In other implementations, a hard mask may be used.

Figure 16:
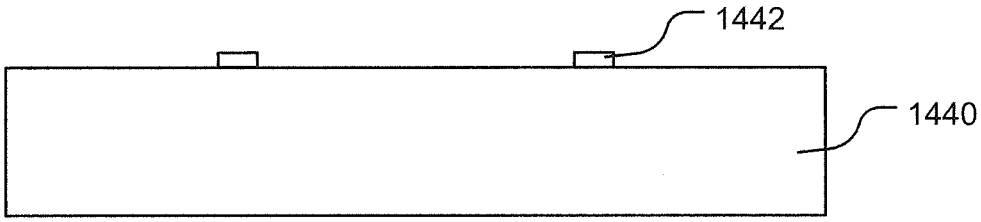

At FIG. 16, the masking material 1442 may be patterned to form a pattern. The pattern may comprise a pattern defining locations of the recesses/protrusions of the plate described herein to be later-formed.

Figure 17:
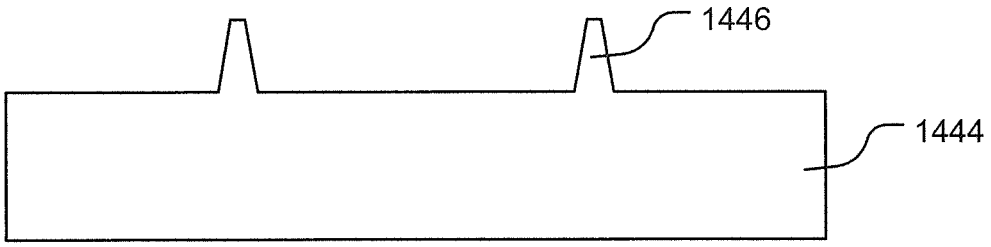

At FIG. 17, the masked mandrel 1440 may be etched to form a patterned mandrel 1444. In various implementations, the masked mandrel 1440 may be etched by a wet operation using hydrogen fluoride or another suitable etchant or by a dry etch through a plasma etchant. The patterned masking material 1442 may be removed either during the etching operation or subsequent thereto. In some implementations, the patterned mandrel 144 may be etched again after the patterned masking material 1442 is removed. The resultant patterned mandrel 1444 may comprise elongated, trapezoidal, conical, or otherwise shaped structure(s) 1446.

Figure 18:
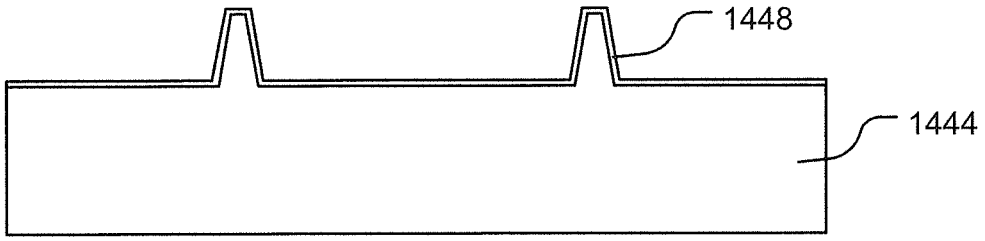

At FIG. 18, a layer 1448 of metal may be formed over the patterned mandrel 1444 to form the mask with which the plate may be formed. In various implementations, the layer 1448 may be formed using any suitable physical deposition operation such as, but not limited to, sputter deposition. In various implementations, the layer 1448 may comprise stainless steel and/or chrome or another material onto which the plate may be electroplated, as described herein.

Figure 19:
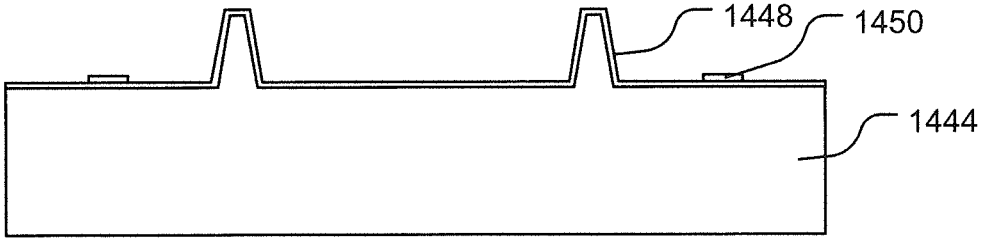

For implementations of the plate including nozzle orifices, the mask may include features 1450 to define the locations of the nozzle orifices, as illustrated in FIG. 19. In various implementations, the features 1450 may be formed by one or more patterning operations such as, but not limited to, plasma-enhanced chemical vapor deposition (PECVD) of the mask material and then patterning of the mask material. In various implementations, the mask material, and resultant features 1450, may comprise silicon carbide or another suitable non-conductive material.

For implementations without nozzle orifices, such as, for example, various MEMS-based apparatuses, the operation(s) of FIG. 19 may be omitted altogether.

Figure 20:
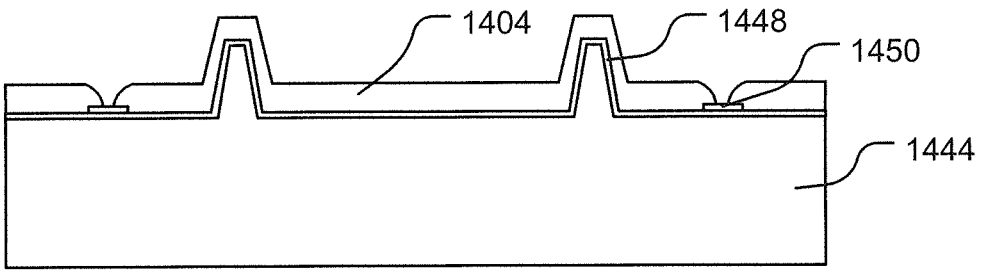

At FIG. 20, the mask comprising the patterned mandrel 1444, the metal layer 1448, and the nozzle pattern features 1450 (when present) may be electroplated with a conductive material to form the plate 1404. In various implementations, the plate 1404 may be formed by immersing the mask into a plating bath that plates the mask everywhere except where the non-conductive nozzle orifice features 1450 are located. The metal from the plating bath, thus, may define the pattern(s), shape(s) and/or feature(s) of the plate 1404. In various implementations, the plating bath may comprise nickel, gold, platinum, rhodium, titanium, or another suitable material for the plate 1404.

Figure 21:
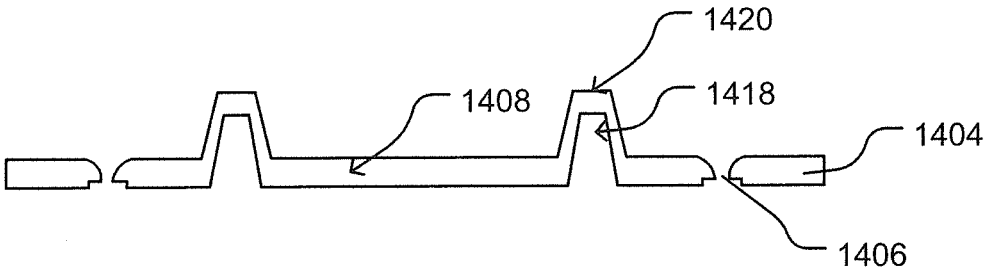

At FIG. 21, the mask having the plate 1404 electroplated thereon may be removed from the electroplating bath, and the plate 1404 may be removed from the mask. As illustrated, the plate 1404 includes nozzle orifices 1406 and recesses 1418 with corresponding protrusions 1420. As noted herein, in some implementations, the nozzle orifices 1406 may be omitted altogether. The plate 1404 may then be coupled to a substrate such that the protrusion 1420 extends towards the substrate and such that the flat portion 1408 of the plate 1404 is in spaced to the substrate to define a chamber (such as, e.g., a firing chamber of a fluid ejection apparatus, an air chamber of a MEMS-based device, etc.).

Various aspects of the illustrative embodiments are described herein using terms commonly employed by those skilled in the art to convey the substance of their work to others skilled in the art. It will be apparent to those skilled in the art that alternate embodiments may be practiced with only some of the described aspects. For purposes of explanation, specific numbers, materials, and configurations are set forth in order to provide a thorough understanding of the illustrative embodiments. It will be apparent to one skilled in the art that alternate embodiments may be practiced without the specific details. In other instances, well-known features are omitted or simplified in order not to obscure the illustrative embodiments.

The phrases "in an example," "in various examples," "in some examples," "in various embodiments," and "in some embodiments" are used repeatedly. The phrases generally do not refer to the same embodiments; however, they may. The terms "comprising," "having," and "including" are synonymous, unless the context dictates otherwise. The phrase "A and/or B" means (A), (B), or (A and B). The phrase "A/B" means (A), (B), or (A and B), similar to the phrase "A and/or B". The phrase "at least one of A, B, and C" means (A), (B), (C), (A and B), (A and C), (B and C), or (A, B and C). The phrase "(A) B" means (B) or (A and B), that is, A is optional. Usage of terms like "top", "bottom", and "side" are to assist in understanding, and they are not to be construed to be limiting on the disclosure.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. It is manifestly intended, therefore, that embodiments be limited only by the claims and the equivalents thereof.

What is claimed is:

1. A fluid ejection apparatus comprising:

a plate including a nozzle orifice, a flat portion, and a first surface having a recess forming a corresponding protrusion extending from a second surface, opposite the first surface, of the plate; and a substrate in spaced relation to the flat portion of the plate such that the protrusion extends toward and is separated from the substrate and such that the flat portion and the substrate define, at least in part, a firing chamber.

2. The apparatus of claim 1, wherein an end of the protrusion extends toward and is exposed to a fluid feed slot of the substrate, the fluid feed slot to provide a fluid to the firing chamber, the substrate and the protrusion defining a filter therebetween to filter particles in the fluid from entering the firing chamber.

3. The apparatus of claim 2, wherein the end of the protrusion extends at least partially over the fluid feed slot.

4. The apparatus of claim 2, wherein the end of the protrusion extends at least partially over the substrate.

5. The apparatus of claim 2, wherein the end of the protrusion extends partially over the fluid feed slot and partially over the substrate.

6. The apparatus of claim 2, wherein the end of the protrusion extends below a surface of the substrate and into the fluid feed slot.

7. The apparatus of claim 1, wherein the plate includes a plurality of other protrusions extending from the first surface of the plate and wherein the flat portion and the substrate define a plurality of other firing chambers, the substrate and each of the plurality of other protrusions defining a filter therebetween to filter particles from entering corresponding ones of the plurality of other firing chambers.

8. The apparatus of claim 1, wherein the flat portion and the substrate define a plurality of other firing chambers, the substrate and the protrusion defining a filter therebetween to filter particles from entering corresponding ones of the plurality of other firing chambers.

9. The apparatus of claim 1, further comprising a barrier layer coupling the flat portion of the plate to the substrate and further defining the firing chamber.

10. The apparatus of claim 1, wherein the plate comprises nickel, gold, platinum, palladium, rhodium, or titanium.

11. The apparatus of claim 1, wherein the apparatus is a printhead or a printing apparatus.

12. The apparatus of claim 1, wherein the protrusion is separated from the substrate by a distance no greater than a height of the protrusion.

13. A fluid ejection apparatus comprising:

a plate including a nozzle orifice, a flat portion, and a first surface having a recess forming a corresponding protrusion extending from a second surface, opposite the first surface, of the plate; and a substrate in spaced relation to the flat portion of the plate such that the protrusion extends toward the substrate and such that the flat portion and the substrate define, at least in part, a firing chamber, wherein the substrate includes a circuit pattern including a first capacitor terminal within the firing chamber and a bond pad on the substrate and external to the firing chamber, and wherein the protrusion is in electrical contact with the bond pad and the flat portion forms a second capacitor terminal to capacitively couple with the first capacitor terminal to determine a presence of a bubble in a fluid in the firing chamber.

* * * * *